US005087006A

United States Patent [19]

Wrench

[11] Patent Number: 5,087,006

[45] Date of Patent: Feb. 11, 1992

[54] APPARATUS FOR ADJUSTMENT OF EFFECTIVE SLOT WIDTH

[76] Inventor: Robert A. Wrench, 8542 32nd Ave. NW., Seattle, Wash. 98117

[21] Appl. No.: 505,136

[22] Filed: Apr. 5, 1990

[51] Int. Cl.[5] ..... A47B 96/06

[52] U.S. Cl. ..... 248/214; 248/345.1

[58] Field of Search ..... 248/345.1, 225.31, 102, 248/214; 269/97, 98, 274; 292/251.5; 5/424, 425, 427

[56] References Cited

U.S. PATENT DOCUMENTS

| | | | |
|---|---|---|---|
| 2,267,113 | 12/1941 | Kyprie | 248/102 |
| 2,564,386 | 8/1951 | Webb | 248/345.1 X |
| 2,660,079 | 11/1953 | Bellows | 269/97 |
| 2,935,352 | 5/1960 | Heppner | 292/251.5 |
| 3,525,493 | 8/1970 | Chrietzberg et al. | 40/606 |
| 3,762,753 | 10/1973 | Yulkowski | 292/349 |
| 3,961,811 | 6/1976 | Brilando et al. | 248/214 X |
| 4,109,887 | 8/1978 | Wakeland, Jr. | 248/345.1 |
| 4,166,601 | 9/1979 | Kato | 248/230 X |
| 4,840,342 | 6/1989 | Sweeny et al. | 248/345.1 X |

FOREIGN PATENT DOCUMENTS

| | | | |
|---|---|---|---|
| 902633 | 12/1944 | France | 269/97 |
| 1273766 | 5/1972 | United Kingdom | 248/225.31 |

*Primary Examiner*—Gary L. Smith
*Assistant Examiner*—Michael Milano
*Attorney, Agent, or Firm*—Robert W. Jenny

[57] ABSTRACT

The subject apparatus is used to reduce the effective width of a slot. The apparatus is a liner installable in the slot and retained in the slot by engagement of projections from the exterior surfaces of the liner with holes in the slot surfaces. The liner is resilient. Its sides are flared and then flexed flat upon installation in the slot. The restoring force caused by the flexing helps hold the projections in the holes and the edges of the liner against the sides of the slot.

1 Claim, 1 Drawing Sheet

APPARATUS FOR ADJUSTMENT OF EFFECTIVE SLOT WIDTH

BACKGROUND OF THE INVENTION

1. Field

This invention is in the field of apparatus which incorporates slots and, more particularly, the field of slotted apparatus having uses which require or are enhanced by adjustment of the width of a slot, or, still more specifically, the effective width of the slot. More specifically, it is in the field of such apparatus requiring one semi-permanent adjustment of the effective width of the slot.

2. PRIOR ART

There is much prior art related to adjusting slot widths but relatively little related to one-time, semi-permanent adjustments. One time adjustments tend to be permanent and made, for example, by gluing a shim in place on one of the opposing faces of a slot. Semi-permanent adjustments usually involve shims held in place by a fastener in the apparatus. There is no known semi-permanent slot width adjustment apparatus usable independently of fasteners and the objective of the subject invention is to provide apparatus for semi-permanent adjustment of the effective width of a slot without involving a fastener. Other objectives are that the apparatus be inexpensive and simple to use, requiring no tools to install.

SUMMARY OF THE INVENTION

The subject invention is apparatus for semi-permanent adjustment of the effective width of a slot. The actual width remains unchanged. The effective width of the slot is reduced by installation of a liner. For example, the effective width of a ½ inch wide slot is reduced to ⅜ of an inch by installation of a 1/16 inch thick liner. The liner is held in place in the slot by projections which extend outward from the exterior surface of the liner and engage indentations in the facing surfaces of the slot. In a preferred embodiment the liner is made of flexible plastic. The liner can be made for use in 3 sided and 4 sided slots.

The liner, thus installed, is not readily removeable and is therefore considered to provide a semi-permanent adjustment of the effective width of the slot. When the liner is to be used in 3 sided slots it is U shaped in crossection and the legs of the U are flared slightly apart. This assures that the projections are held in the indentations and the edges of the end are held against the facing sides of the slot.

The invention is described in more detail below with reference to the attached drawings.

DETAILED DESCRIPTION OF THE INVENTION

Figure 1:
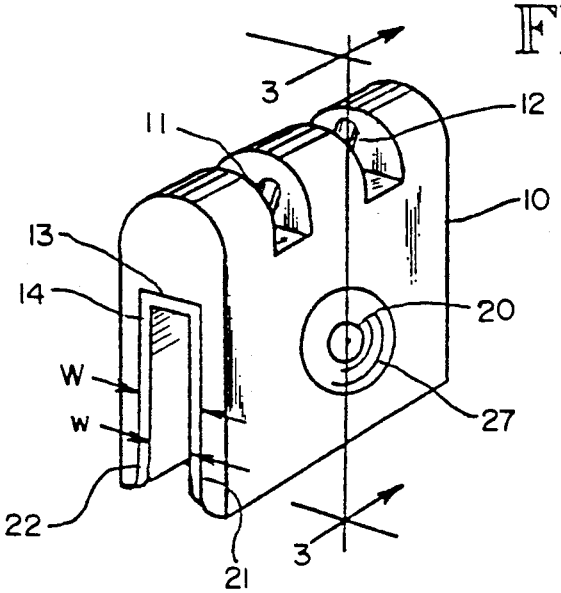
FIG. 1 is a perspective view of a slotted holder with the subject apparatus installed in the slot.

The subject invention is apparatus for semi-permanent adjustment of the effective width of a slot. FIG. 1 illustrates a holder 10 for knife and scissors sharpening apparatuses 11 and 12 respectively. Slot 13 in the holder fits over the side panel of a drawer when the sharpeners are used. Width W of the slot is such that the holder fits closely on a side panel ½ inch thick. With liner 14 installed, the effective width w of the slot is adjusted such that the holder fits closely on a side panel ⅜ of an inch thick.

Figure 2:
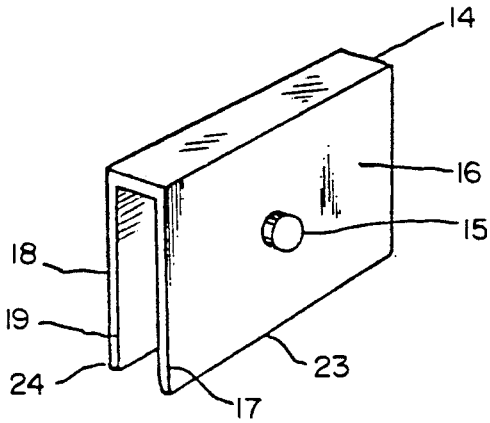
FIG. 2 is a perspective view of the subject apparatus.

Liner 14, U shaped in crossection, is shown in FIG. 2. Projection 15 on the exterior surface 16 of side 17 and a similar one on the exterior surface 18 of side 19 engage hole 20 in face 21 of the slot and a similar hole in opposing face 22 to retain the liner in the slot. The liner is shaped so that its exterior surfaces fit against opposing faces of the slot. Sides 17 and 19 are resilient and flared slightly away from each other. When the liner is installed in a slot the sides are flexed to be essentially parallel and the restoring force caused by the resilience presses the projections into the holes and holds edges 23 and 24 against faces 21 and 22. The pressure enhances the retention of the liner in the slot. There may be more than one projection and accommodating hole per face of the slot.

Removal of the liner requires simultaneous insertion of sharp edged blades between the sides of the liner and the slot faces or simultaneous pressure on the two projections to disengage the projections from the holes. Requirement for this specific removal technique is considered to indicate that the installation of the liner in the slot is semi-permanent.

Figure 3:
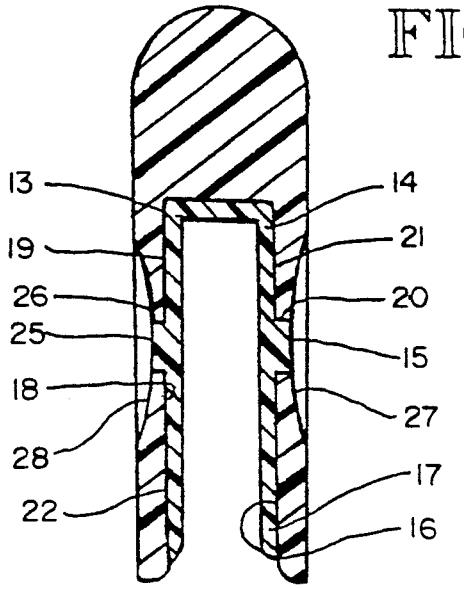
FIG. 3 is a sectional view taken at 3—3 in FIG. 1.

FIG. 3 is a sectional view taken at 3—3 in FIG. 1. As indicated, exterior surface 16 of side 17 of the liner 14 is against face 21 of slot 13 and exterior surface 18 of side 19 is against face 22 of slot 13. Projections 15 and 25 are cylindrical stubs and engage holes 20 and 26 to retain the liner in the slot. Shallow indentations in sides 27 and 28 of the holder (see FIG. 1) provide grip for use in removing the holder from the side panel of the drawer on which it is used.

It is understood that projections as shown or any of a variety of equivalent projections can be used and that they can engage in cavities in the faces of the slot as well as holes. For purposes of this disclosure cavities may be termed holes.

It is considered to be understandable from this description that the invention meets its objectives. It provides apparatus for the semi-permanent adjustment of the effective width of a slot without involving fasteners. Also, the apparatus is inexpensive and simple to use, requiring no tools for installation.

It is also considered to be understandable that while one embodiment of the invention is described herein, other embodiments and modifications of the one described are possible within the scope of the invention which is limited only by the attached claims.

I claim:

1. In combination, a holder and apparatus for adjusting the effective width of a slot, said slot being in said holder and having two opposed faces and at least one hole in each of said two faces, said apparatus comprising a liner shaped to fit into said slot and having exterior surfaces which fit against said two faces and projections on said surfaces, said projections engaging said at least one hole in each of said two faces.

whereby the engagement of said projections in said holes retains said liner in said slot, and further, whereby without said apparatus for adjusting in place in said holder said slot has a first effective width and with said apparatus for adjusting in place in said holder said slot has a second effective width, said holder having two outside surface, each of which is parallel to one of said two opposed faces and each of said holes in each of said two faces extends through said outside surface which is parallel to said face, whereby, said projections are accessible to be pressed out of said holes to enable removal of said apparatus for adjusting from said slot, said liner being resilient and having two sides, said sides being flared away from each other, whereby when said liner is installed in said slot said sides are flexed to be essentially parallel and said flexing causes restoring forces tending to hold said projections in said holes.

* * * * *